US007549706B2

(12) United States Patent
Scheurer et al.

(10) Patent No.: US 7,549,706 B2
(45) Date of Patent: Jun. 23, 2009

(54) BUOYANT POOL CHAIR WITH SEALED FRAME

(75) Inventors: Robert S. Scheurer, Wichita Falls, TX (US); Michael L. Perry, Wichita Falls, TX (US)

(73) Assignee: TRC Recreation, LP, Wichita Falls, TX (US)

( * ) Notice: Subject to any disclaimer, the term of this patent is extended or adjusted under 35 U.S.C. 154(b) by 0 days.

(21) Appl. No.: 11/678,958

(22) Filed: Feb. 26, 2007

(65) Prior Publication Data

US 2007/0132295 A1 Jun. 14, 2007

Related U.S. Application Data

(63) Continuation of application No. 10/884,442, filed on Jul. 3, 2004, now Pat. No. 7,182,401, which is a continuation of application No. 10/379,318, filed on Mar. 3, 2003, now Pat. No. 6,783,181, which is a continuation of application No. 10/053,022, filed on Nov. 2, 2001, now Pat. No. 6,527,343, which is a continuation of application No. 09/447,173, filed on Nov. 22, 1999, now Pat. No. 6,312,054, which is a continuation-in-part of application No. 09/178,818, filed on Oct. 26, 1998, now Pat. No. 6,086,150.

(51) Int. Cl.
*A47C 7/02* (2006.01)

(52) U.S. Cl. ..... 297/452.18; 297/452.19; 297/219.1; 441/129; 441/130; 441/132

(58) Field of Classification Search ..... 297/219.1, 297/452.19, 452.18; 441/129, 130, 132
See application file for complete search history.

(56) References Cited

U.S. PATENT DOCUMENTS

| | | | |
|---|---|---|---|
| 3,074,759 | A | 1/1963 | Bergenwall |
| 3,154,345 | A | 10/1964 | Lambrecht |
| 3,620,570 | A | 11/1971 | Wilson |
| 3,984,888 | A | 10/1976 | DeLano |
| 4,026,567 | A | 5/1977 | Rye |
| 4,358,866 | A | 11/1982 | Rhodes |
| 4,384,857 | A | 5/1983 | Hoy, Jr. |

(Continued)

*Primary Examiner*—Anthony D Barfield
(74) *Attorney, Agent, or Firm*—Scott T. Griggs; Griggs Bergen LLP

(57) ABSTRACT

A buoyant pool chair supports a swimmer in an upright, semi-reclining or sitting position while the chair is floating in a swimming pool. Interconnected rigid frame members collectively form an open chair frame for supporting buoyant cushions. The buoyant cushions include layers of flexible cushion material secured together in overlapping relation, with the frame members being sandwiched between the overlapping layers. A layer of adhesive material bonds the overlapping cushion layers together and forms a water-tight seal around the frame members. A flexible layer of a water-resistant coating material is bonded to external surface portions of the buoyant cushions to provide a further protective layer and water-tight seal.

15 Claims, 13 Drawing Sheets

U.S. PATENT DOCUMENTS

| | | | |
|---|---|---|---|
| 4,435,165 | A | 3/1984 | Johnson |
| 4,484,781 | A | 11/1984 | Phelps |
| 4,662,852 | A | 5/1987 | Schneider et al. |
| 4,884,840 | A | 12/1989 | Linden et al. |
| 5,004,296 | A | 4/1991 | Ziegenfuss, Jr. |
| 5,052,965 | A | 10/1991 | Klapp et al. |
| 5,088,723 | A | 2/1992 | Simmons |
| 5,226,184 | A | 7/1993 | Cheng |
| 5,307,527 | A | 5/1994 | Schober |
| 5,403,220 | A | 4/1995 | Goad, Sr. |
| 5,439,405 | A | 8/1995 | Storey et al. |
| 6,045,423 | A | 4/2000 | Silvia |
| 6,059,360 | A | 5/2000 | Bedard |
| 6,086,150 | A | 7/2000 | Scheurer et al. |
| 6,312,054 | B1 | 11/2001 | Scheurer et al. |
| 6,527,343 | B2 | 3/2003 | Scheurer et al. |
| 6,783,181 | B2 | 8/2004 | Scheurer et al. |
| 2004/0232753 | A1 | 11/2004 | Scheurer et al. |
| 2006/0061180 | A1 | 3/2006 | Scheurer et al. |

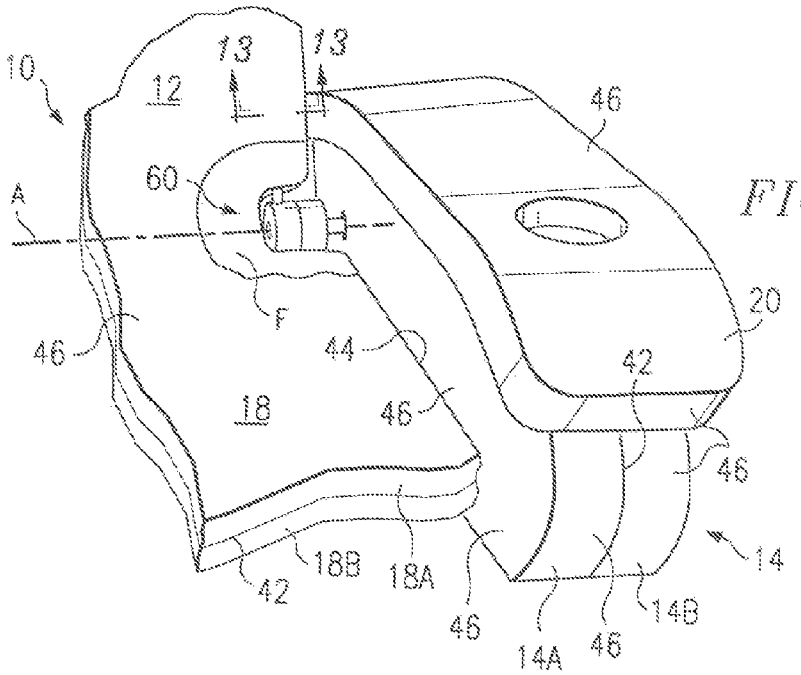
FIG. 12
FIG. 13
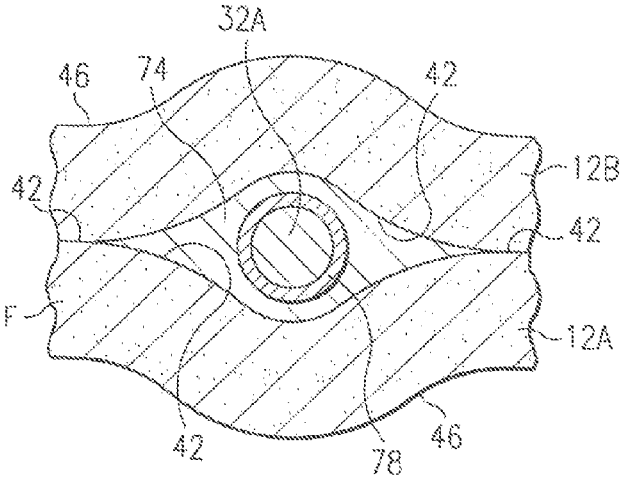
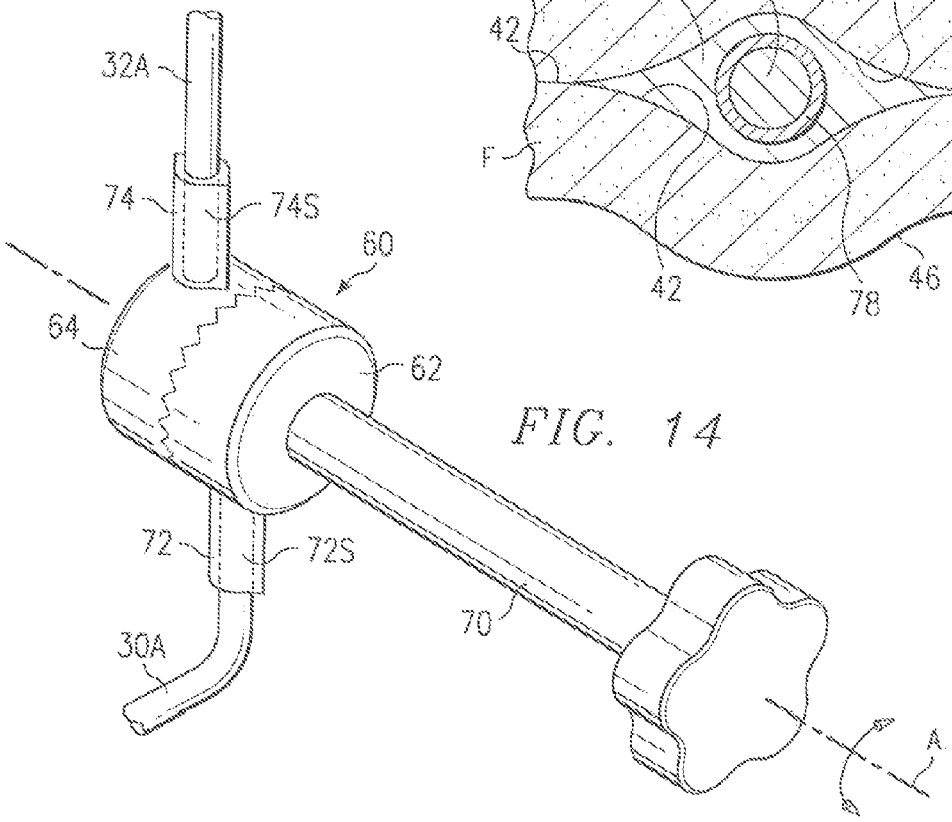
FIG. 14

BUOYANT POOL CHAIR WITH SEALED FRAME

PRIORITY STATEMENT & CROSS-REFERENCE TO RELATED APPLICATIONS

This application is a continuation of application Ser. No. 10/884,442, filed on Jul. 3, 2004, now U.S. Pat. No. 7,182,401 and entitled "Buoyant Pool Chair With Sealed Frame"; which is a continuation of application Ser. No. 10/379,318, filed on Mar. 3, 2003, entitled "Buoyant Pool Chair", and issued on Aug. 31, 2004 as U.S. Pat. No. 6,783,181; which is a continuation of application Ser. No. 10/053,022, filed on Nov. 2, 2001, entitled "Buoyant Pool Chair With Adjustable Angle of Recline", and issued on Mar. 4, 2003 as U.S. Pat. No. 6,527,343; which is a continuation of application Ser. No. 09/447,173, filed on Nov. 22, 1999, entitled "Buoyant Pool Chair With Adjustable Angle of Recline", and issued on Nov. 6, 2001 as U.S. Pat. No. 6,312,054; which is a continuation-in-part of application Ser. No. 09/178,818, filed on Oct. 26, 1998, entitled "Fabrication of Vinyl Coated Pool Chair", and issued on Jul. 11, 2000 as U.S. Pat. No. 6,086,150; all of which are hereby incorporated by reference for all purposes.

TECHNICAL FIELD OF THE INVENTION

This invention relates generally to swimming pool accessories, and in particular to a buoyant lounge chair for supporting a person in a seated position while the chair is floating in water.

BACKGROUND OF THE INVENTION

Swimming pools offer personal recreation and relaxation in a variety of settings, for example in private homes, apartment complexes, motels, resorts and country clubs. Various flotation devices including buoyant chairs, rafts, water wings, floating cushions, body floats and air mattresses are used by swimmers as an aid for floating and relaxing on the surface of the water, while remaining seated upright, reclining or lounging, either partially or completely submerged. These items of pool furniture include flotation cushions made of a buoyant material such as open cell foam, closed cell foam, cork, kapok, fiberglass or balsa wood, which are sealed within a protective outer covering.

A popular item of pool furniture is the buoyant lounge chair that permits a swimmer to relax on the surface of the water in a seated, semi-reclining orientation. In some lounge chair designs, the angle of recline is fixed and determined by the form of the rigid frame on which buoyancy cushions are attached, for example as shown in U.S. Pat. No. 6,086,150, which is incorporated herein by reference. In other lounge chair designs, the chair back is pivotably coupled to the frame on which buoyancy cushions are attached, for example as shown in U.S. Pat. No. 6,312,054, which is incorporated herein by reference. Those buoyant lounge chairs, manufactured and sold by Texas Recreation Corporation of Wichita Falls, Tex. have met with considerable commercial success. The present invention was stimulated by the need for a buoyant lounge chair having pivotal chair back that can be set in an upright, semi-reclining sitting position, in which the pool chair functions essentially as a buoyant chair, to a fully folded, minimum profile configuration for storage purposes, and to facilitate handling and shipment. For convenience and comfort, the back rest should be easily set in the standard angle of recline provided by conventional fixed-back lounge chairs.

According to another conventional buoyant lounge chair arrangement, as shown in U.S. Pat. No. 4,662,852, the back rest frame is pivotally connected to the seat frame and is inclined against a rear cross bar, and the seat frame is braced by releasable engagement of a slotted bracket with a forward cross bar. The angle of recline is adjusted by extending and retracting the slotted bracket relative to the forward cross bar. This movement translates into angle of recline adjustment as the two sections pivot about a common hinge axis.

An important consideration in the design and construction of buoyant lounge chairs, including those including a foldable back, is the maintenance of a water-tight seal about the cushion material and around the welded metal frame. The interlocking components of the foldable seat back coupling apparatus should also be protected.

The external surface of the lounge chair is susceptible to attack by mildew, fungus, surface hardening, cracking and shrinking that are caused by long-term exposure to water, pool chemicals and solar radiation. Consequently, lounge chairs as well as other buoyant flotation devices are desirably protected by a durable, non-reactive coating of plastic material, such as vinyl. The protective coating must be soft, pliable and able to withstand rough handling and high shear forces along the joinder lines between the chair arms, the chair seat, and along the flex lines between the chair back and chair seat. The protective coating is applied by various processes, including dipping and spraying, preferably as set forth in U.S. Pat. No. 6,086,150, incorporated herein by reference.

Another limitation imposed by the construction of conventional lounge chairs is that the buoyant arm support sections are subject to tearing or deformation, and are also subject to collapse and separation from the chair frame at the interface between the arm support sections and the chair seat.

Special care should be taken in the construction of buoyant lounge chairs to provide sufficient buoyancy material to maintain a stable upright orientation while the occupant is in a semi-reclining or sitting orientation. The buoyant lounge chair can overturn in response to shifting of its center of buoyancy as the occupant turns or moves about.

SUMMARY OF THE INVENTION

The buoyant lounge chair of the present invention provides stable support for a swimmer in an upright, semi-reclining or sitting position while the chair is floating in a swimming pool. Interconnected rigid frame members collectively form an open chair frame. In the preferred embodiment, the frame members include a seat frame, left and right side arm frames attached to the seat frame, and a movable back frame. The back frame is pivotally coupled to the seat frame on opposite sides by dual axle shafts. A manually operable clutch is mounted on each axle shaft for releasably connecting the seat frame to the back frame. Each clutch is manually releasable to permit pivotal movement of the back frame relative to the seat frame, and is manually engagable to fix the angle of recline of the back frame relative to the seat frame, for example for use in the upright sitting position.

Buoyant cushions are attached to the frame members, thereby forming a chair seat, a chair back, left and right chair arms and a bolster block. The buoyant cushions forming the chair seat, the chair arms, the chair back and the bolster block each include layers of buoyant cushion material secured and sealed together by an adhesive deposit in overlapping relation, with each chair frame member being enclosed and sealed between a pair of buoyant layers. Each axle shaft and clutch are also enclosed between a pair of the buoyant layers. Each clutch includes a manual actuator that extends laterally through a passage formed in a pair of buoyant arm cushions, and projects externally of each chair arm at a side location in which it can be conveniently manipulated for engaging and releasing the clutch while the operator is seated or reclining on the lounge chair.

Each buoyant arm support section is reinforced by an upright arm support riser that is laterally offset from the seat frame and by a horizontal arm rest segment that is vertically offset from the seat frame. The left and right buoyant chair arms are stabilized and reinforced against collapse and separation from the chair frame by the upright arm support risers and the horizontal arm rest segments that are sandwiched between the buoyant arm support cushions.

In the preferred embodiment, the left and right arm support cushions project aft of the pivotal union between the chair seat the chair back. According to this arrangement, the aft projecting portions of the arm support cushions overlap the laterally opposite end portions of the bolster block. The arm support cushions are reinforced against deflection and separation from the chair frame by an aft extension bar attached to the arm rest frame. The extension bar is laterally offset from the seat frame and from the back frame, and projects aft of the pivotal clutch union. The buoyant arm support cushions are further reinforced and stabilized against vertical deflection by the clutch actuator which extends laterally through the buoyant arm cushions.

According to another aspect of the invention, the upright floating stability of the lounge chair is improved by extension portions of the buoyant arm cushions that project aft of the chair seat, substantially overlapping the opposite end portions of the bolster block. The upright floating stability of the lounge chair is also improved by a seat frame assembly including left and right seat frame segments each including an angled connecting portion attached to a central seat frame segment. The angled connecting portions slope downwardly relative to the seat frame segments, whereby the buoyant cushions in combination with the seat frame segments form a leg support section that slopes downwardly relative to the chair seat and buoyant arm cushions.

The floating stability of the lounge chair is further improved by buoyant arm rest cushions which are mounted on top of the left arm and right arm support cushions. The arm rest cushions extend aft of the seat frame/back frame pivotal clutch union, substantially in flush alignment with the bolster block when the seat back is set in the upright lounging position.

BRIEF DESCRIPTION OF THE DRAWINGS

The accompanying drawing is incorporated into and forms a part of the specification to illustrate the preferred embodiments of the present invention. Various advantages and features of the invention will be understood from the following detailed description taken in connection with the appended claims and with reference to the attached drawing figures in which:

FIG. 12 is a perspective view of the buoyant lounge chair shown in FIG. 1, partially broken away, showing details of the pivotal coupling and clutch assembly which connect the foldable back frame to the seat frame;

FIG. 13 is a sectional view, partially broken away, taken along the line 13-13 of FIG. 1 showing abutting cushion layers that are adhesively sealed together around a portion of the back frame;

FIG. 14 is a perspective view, partially broken away, of the pivotal coupling and clutch assembly shown in FIG. 12;

DETAILED DESCRIPTION OF THE INVENTION

Figure 1:
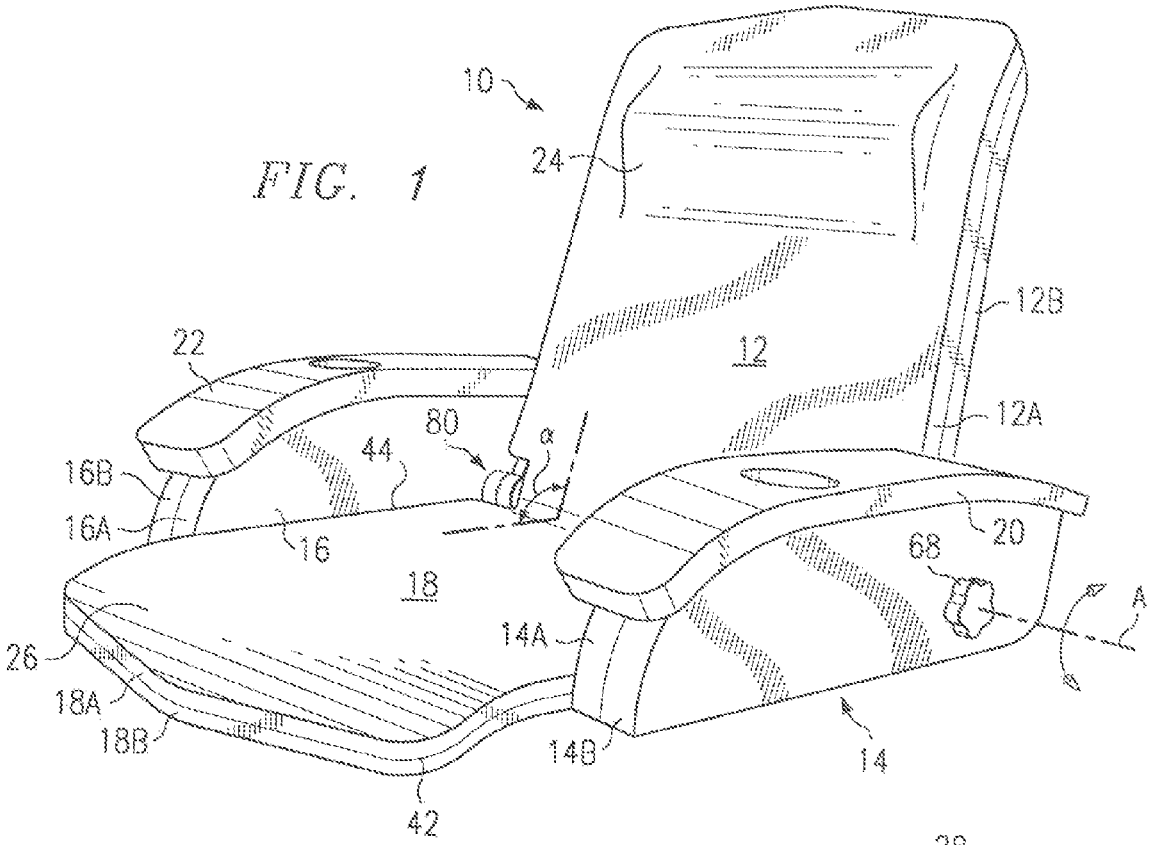
FIG. 1 is perspective view of a buoyant lounge chair constructed according to the preferred embodiment of the present invention.

Preferred embodiments of the invention will now be described with reference to various examples of how the invention can best be made and used. Like reference numerals are used throughout the description and several views of the drawing to indicate like or corresponding parts.

Referring now to FIG. 1-FIG. 7, there is illustrated an exemplary embodiment of a light-weight buoyant lounge chair 10 for selectively supporting a person in seated, semi-reclining and fully reclining lounge positions while the chair is floating in water. The lounge chair 10 includes an adjustable chair back 12, chair arms 14, 16, a chair seat 18 and arm rest cushions 20, 22 which provide full body support in the seated, upright, semi-reclining, reclining and fully reclining lounge positions.

The operative upright floating position refers to the flotation orientation of the lounge chair 10 with the chair back 12 and chair arms 14, 16 generally upright while the chair seat 18 is generally horizontal and at least partially submerged as indicated in FIG. 1. When the lounge chair is floating in water, the occupant is supported in a comfortable lounging orientation, with his arms being supported by the left arm rest cushion 20, the right arm rest cushion 22 and his head is supported by a head support cushion 24. The occupant's legs are supported by a leg support section 26 which projects forwardly from the chair seat 18.

Figure 2:
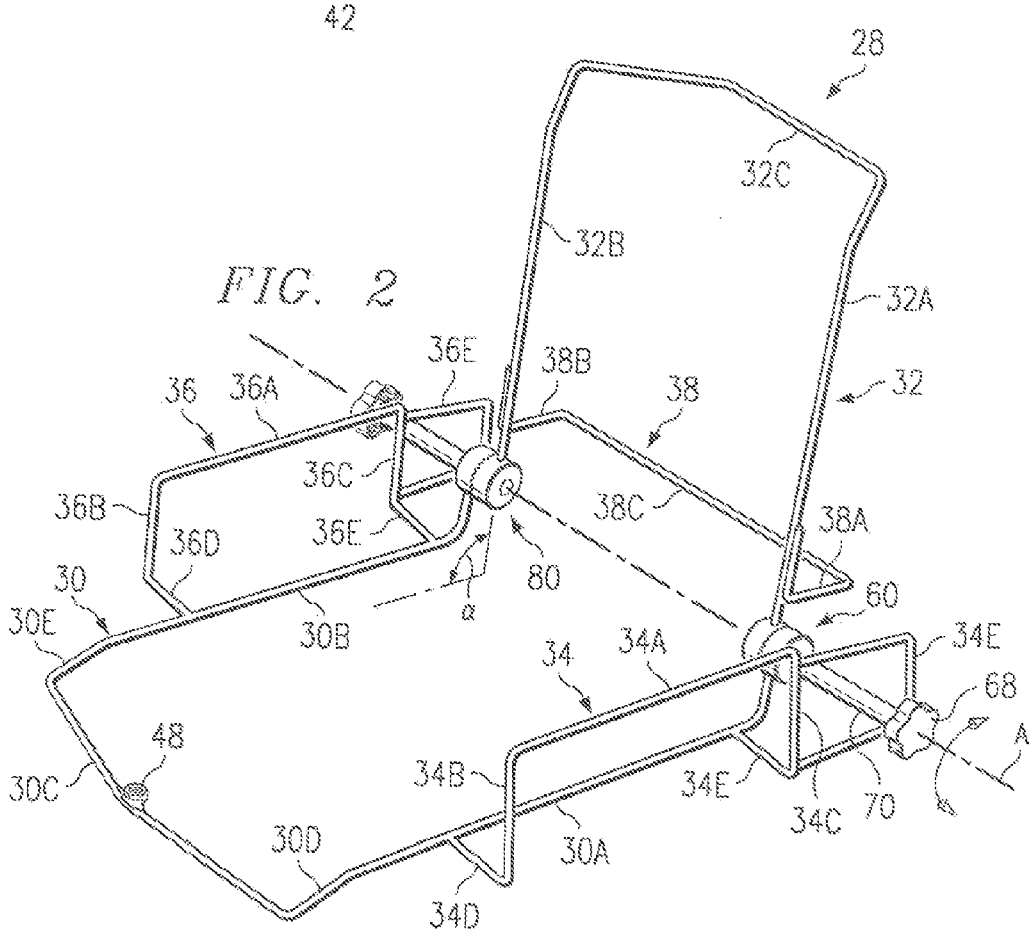
FIG. 2 is a perspective view thereof showing interconnected rigid frame members including a pivotally coupled back frame collectively forming an open chair frame.
Figure 3:
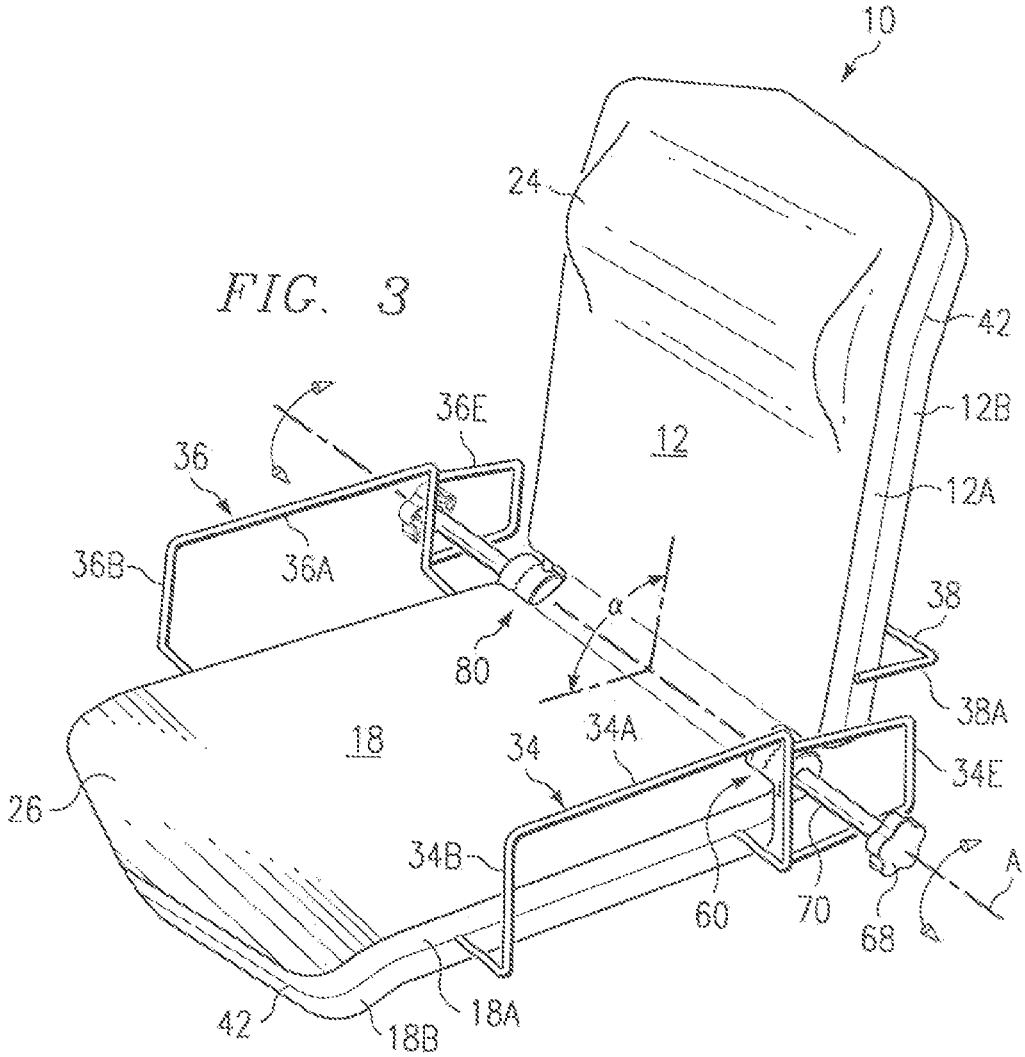
FIG. 3 is a perspective view showing first and second layers of buoyant cushion material secured together in overlapping relation, with the seat frame and back frame of the chair being sandwiched between the buoyant layers, the top layer forming a continuous body support surface that transitions through the pivotal union between the seat frame and the back frame.
Figure 4:
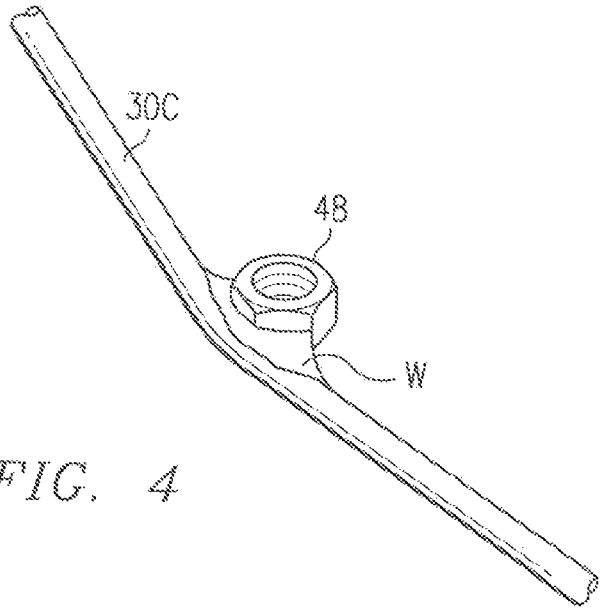
FIG. 4 is a perspective view of a portion of the seat frame, showing a threaded coupling nut welded onto a central seat frame segment.
Figure 10:
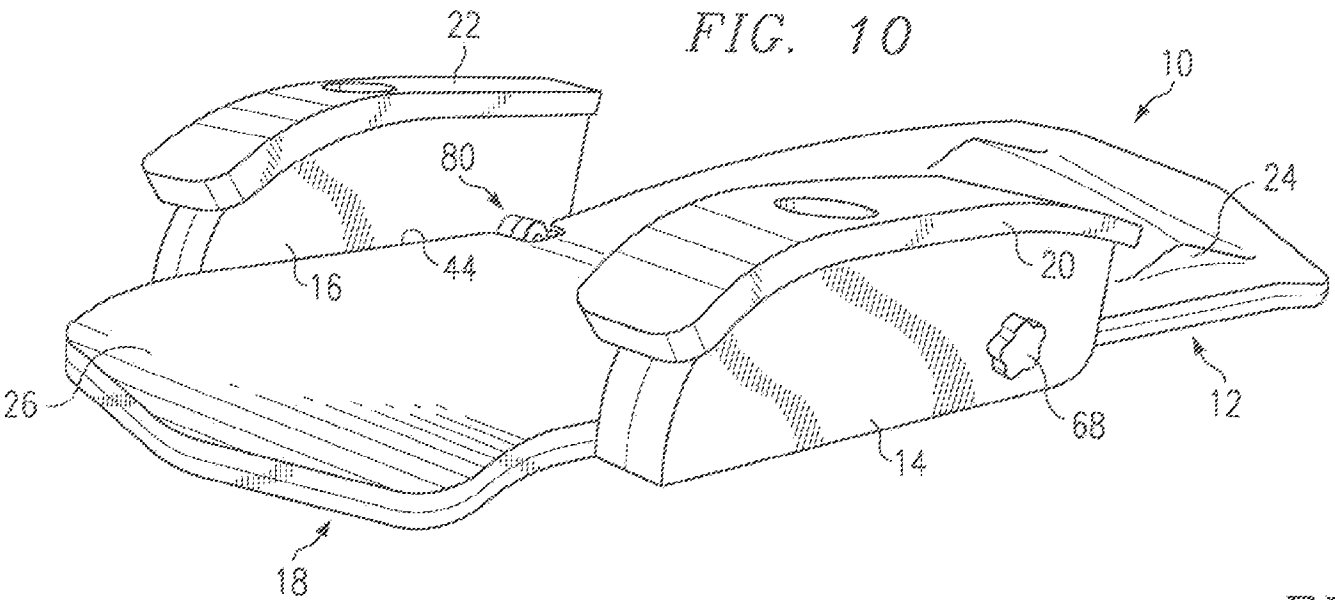
FIG. 10 is a perspective view of the fully assembled buoyant lounge chair of FIG. 1 with the back unfolded to the fully reclining (body float) position.

Buoyancy sufficient to support an adult occupant having a body weight up to 250 lbs. is provided by multiple pairs of overlapping buoyant cushions that are attached to an open chair frame 28 shown in FIG. 2. The open chair frame 28 is a skeleton frame formed by interconnected rigid frame members, preferably 5/16 inch diameter steel rod segments that are welded together. The rigid steel rod segments form a seat frame 30, a back frame 32 that is pivotally coupled to the seat frame along a pivotal axis A and is adjustable through an incline angle $\alpha$, which ranges from about 10° in the folded configuration (FIG. 11) to about 180° in the fully extended, body float configuration (FIG. 10). A left arm frame 34 and a right arm frame 36 are attached to the seat frame but are separated from the back frame to permit free movement of the back frame during adjustment of the recline angle $\alpha$. A bolster frame 38 is welded onto the back frame 32, projecting aft of the chair frame and extending laterally substantially from the left side to the right side of the chair frame 28.

Buoyant cushions formed by overlapping layers of buoyant cushion material are attached to the individual steel rod frame segments, thereby forming the buoyant chair back 12, the left chair arm 14, the right chair arm 16, the chair seat 18 and a bolster block 40. Each buoyant cushion is formed by a pair of overlapping layers of buoyant material, preferably slabs of closed cell polyurethane foam F having a density in the range of 1-6 lbs./cu.ft. Each closed cell foam layer is in the form of a rectangular slab, having a typical thickness in the range of 1-2 inches, and is cut to form a lounge chair having an assembled height of 27 inches, a length of 30 inches and a width of 30 inches.

Referring again to FIG. 2, FIG. 3, FIG. 5, FIG. 6 and FIG. 13, overlapping pairs of buoyant cushions are attached and secured onto the chair frame members by an adhesive bonding agent, for example a deposit 42 of a fast setting contact cement, with the frame members being enclosed and sealed between the layers, thereby providing structural reinforcement for the soft, buoyant cushions. For this purpose, the chair seat 18 is formed by a pair of overlapping cushion layers 18A, 18B; the left chair arm is formed by a pair of overlapping arm support cushions 14A, 14B, with the left arm frame 34 being enclosed and sealed between the overlapping layers 14A, 14B.

Likewise, the right arm 16 is formed by a pair of overlapping cushion layers 16A, 16B that are adhesively bonded together with the right arm frame 36 being enclosed and sealed between the overlapping layers. The chair back 12 is also formed by overlapping cushion layers 12A, 12B which are adhesively bonded together, with the back frame 32 being enclosed and sealed between the overlapping cushion layers. The bolster block 40 is also formed by overlapping buoyant cushion layers 40A, 40B that are adhesively bonded together with the bolster frame 38 being enclosed and sealed between the overlapping cushion layers.

Figure 5:
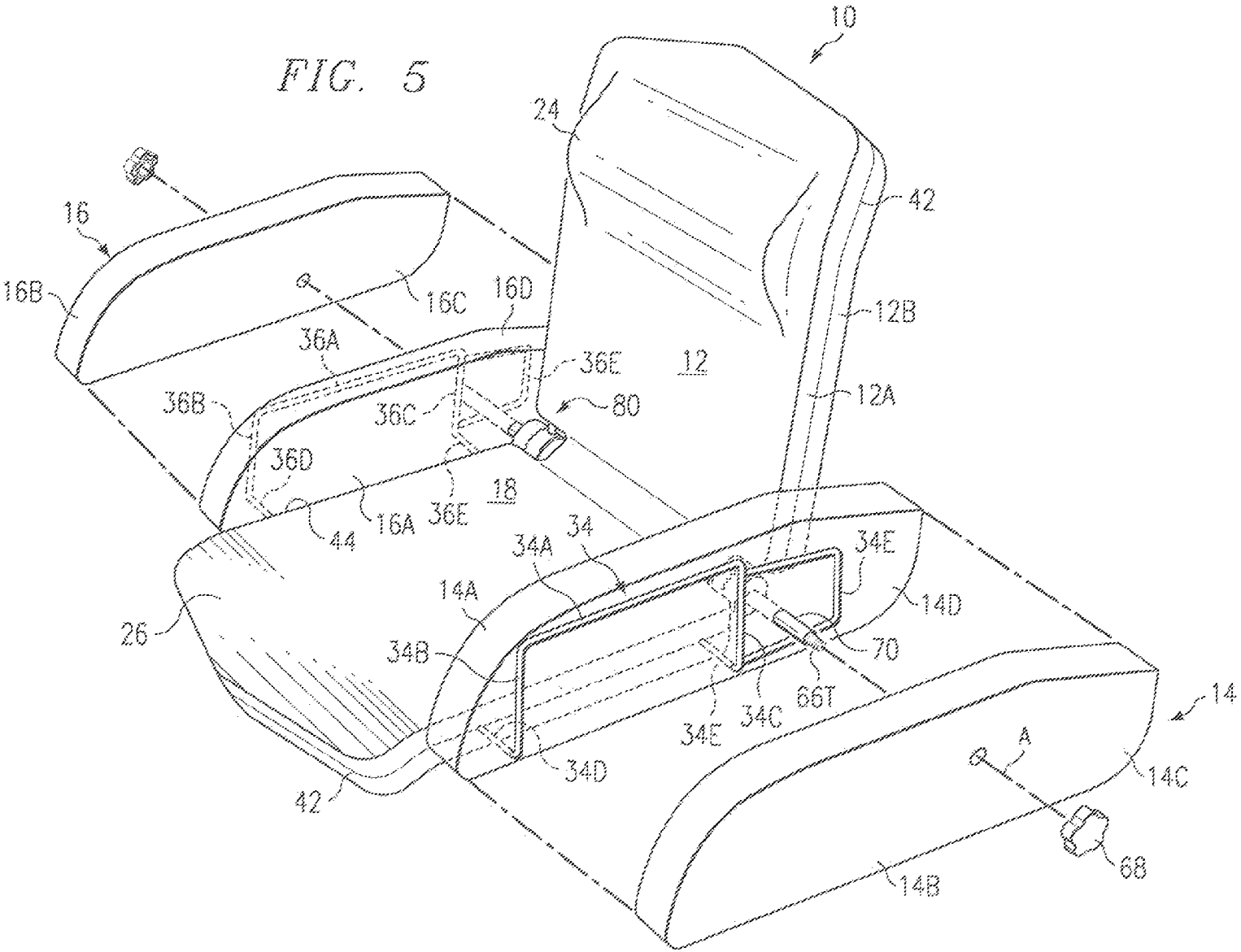
FIG. 5 is a perspective view similar to FIG. 3, showing the assembly of buoyant arm support cushions onto the left and right arm frames.
Figure 7:
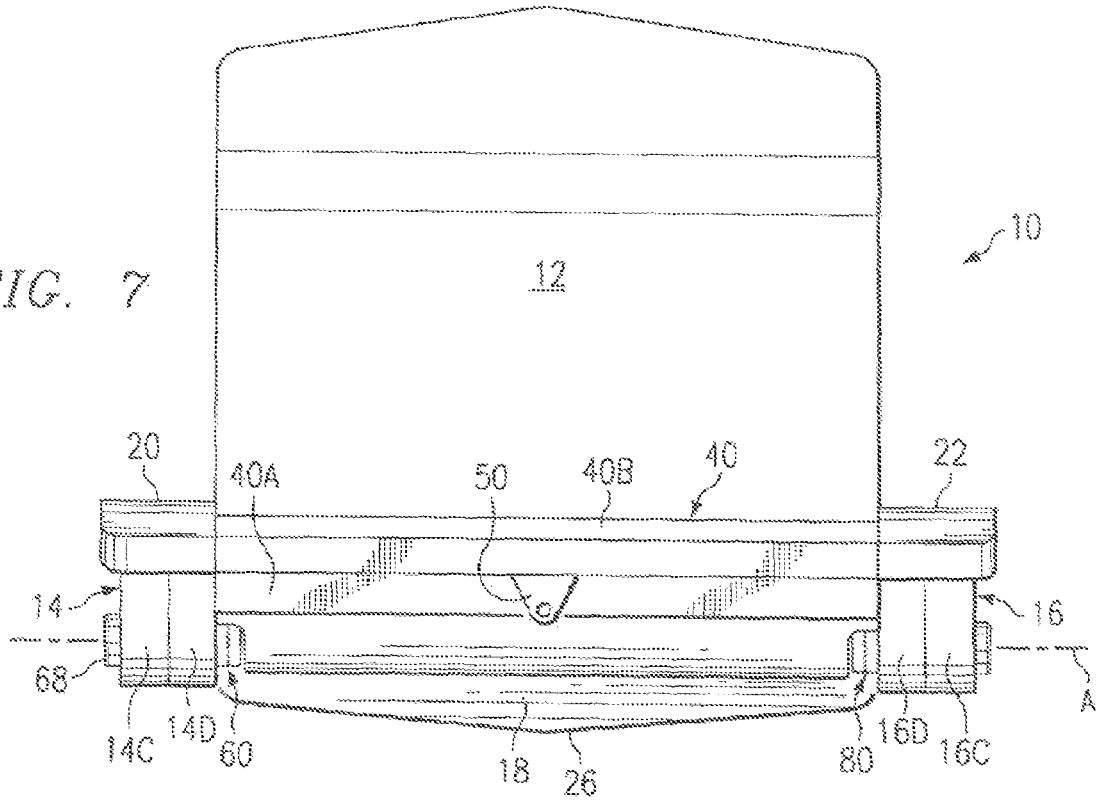
FIG. 7 is a rear elevational view of the buoyant lounge chair shown in FIG. 1.

Referring again to FIG. 1 and FIG. 5, the left and right chair arms 14, 16 are stabilized further by adhesive attachment to the left and right side edge portions of the chair seat 18. The chair arms overlap the laterally opposite sides of the chair back 12, but are not attached to it. The left and right arm support cushions are further stabilized by adhesive attachment to the left arm rest cushion 20 and right arm rest cushion 22 which bridge across the overlapping cushion layers 14A, 14B and 16A, 16B, respectively. As shown in FIG. 5 and FIG. 7, aft projecting end portions 14C, 14D and 16C, 16D of the left arm support 14 and right arm support 16 overlap the opposite ends of the bolster block 40, which further improves the buoyancy and floating stability of the lounge chair.

The buoyant arm support sections 14, 16 are reinforced by the side arm frames 34, 36. The side arm frame 34 includes an upright arm support riser segment 34B that is laterally offset from the seat frame by an angled linking segment 34C. The side arm frame also includes a horizontal arm rest segment 34A that is vertically offset from the seat frame.

The right side arm frame is identically reinforced by a horizontal arm rest segment 36A, an upright arm support riser 36B and an angled linking segment 36C attached to the seat frame 30B. The left and right arm support cushions are thus stabilized and supported against collapse and separation from the chair frame by the rigid support provided by the left and right arm segments that are enclosed and sealed between the buoyant arm support cushions, as indicated in FIG. 13.

The aft projecting arm support cushions 14C, 14D and 16C, 16D are reinforced against deflection and separation from the chair frame by extension bars 34E, 36E, respectively. The extension bars 34E, 36E are welded onto the side arm frames 34, 36, respectively. The extension bars are laterally offset from the seat frame 30, and project aft of the pivotal union between the back frame 32 and the seat frame 30. The upright floating stability of the lounge chair is improved by the aft extending portions of the buoyant arm cushions which project aft of the pivotal union, whereby the aft projecting portions substantially overlap the laterally opposite end portions of the bolster block 40.

The upright floating stability of the lounge chair 10 is further improved by the seat frame assembly 30 which includes left and right seat frame segments 30A, 30B and a central seat frame segment 30C. The central seat frame segment 30C is connected on opposite ends to the seat frame side segments by angled connecting segments 30D, 30E. The seat frame segments are enclosed and sealed between the buoyant chair seat cushions 18A, 18B. The floating stability of the lounge chair is improved by the leg support section 26 that slopes downwardly from the chair seat 18, as shown in FIG. 1. The downward slope is provided by the angled seat frame segments 30D, 30E, as shown in FIG. 2.

Figure 6:
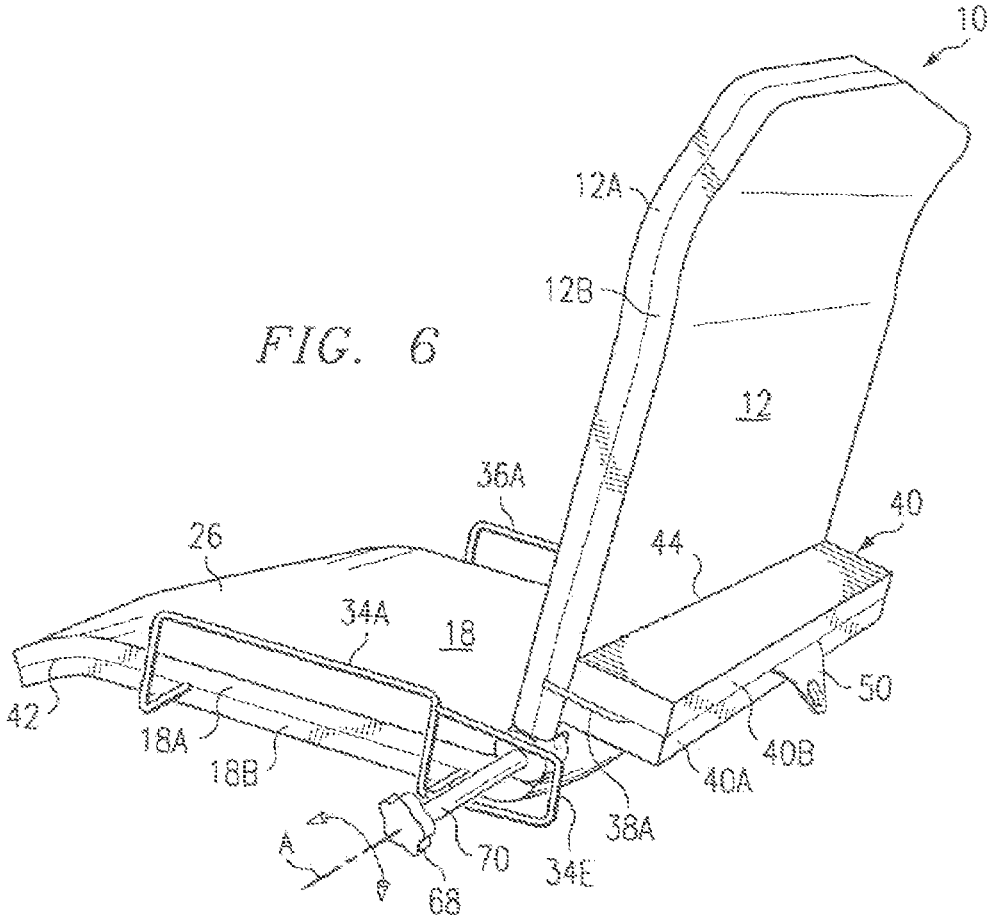
FIG. 6 is a rear perspective view of the buoyant lounge chair showing a bolster frame sandwiched between a pair of buoyant cushions.

The floating stability of the lounge chair is also improved by attaching the bolster block 40 onto the back frame 32 so that its moment arm spacing relative to the pivotal axis A remains constant as the chair back is adjusted throughout its angle of incline range. Referring to FIG. 2, FIG. 5 and FIG. 6, the bolster frame 38 includes left and right bolster frame segments 38A, 38B that project downwardly from the back frame 32, and are sandwiched between the lower and upper buoyant bolster cushions 40A, 40B. The bolster frame segments 38A, 38B maintain the bolster block 40 in a transverse orientation relative to the chair back 32 as the incline angle $\propto$ is adjusted from one position to another. Preferably, the bolster frame segments 38A, 38B slope transversely so that the bolster block 40 is inclined by about 20° relative to the horizontal arm support segments 34A, 36A when the lounge chair back is in the upright floating position.

Referring now to FIG. 1 and FIG. 13, the overlapping buoyant cushions are bonded and sealed together by a thin layer of adhesive 42. Additionally, the surface portions of the buoyant cushions bordering the lines of abutting engagement between the chair seat and the left and right chair arms, and between the chair back and the bolster block are further bonded together and sealed by a layer of flexible caulking material 44. Preferably, the caulking material 44 is a high grade, 15-25 year acrylic material that provides good adhesion to the surface of the closed cell foam, and can withstand high shear forces arising along the interface surfaces. After the caulking material 44 has been applied and cured, a layer of solvent-based vinyl coating material 46 is applied to the exposed external surfaces of the lounge chair. Preferably, the protective vinyl coating 46 is applied over the external surfaces of the lounge chair 10 while it is suspended on a threaded weldment 48 from a hanger strap as described and claimed in our U.S. Pat. No. 6,086,150.

Figure 11:
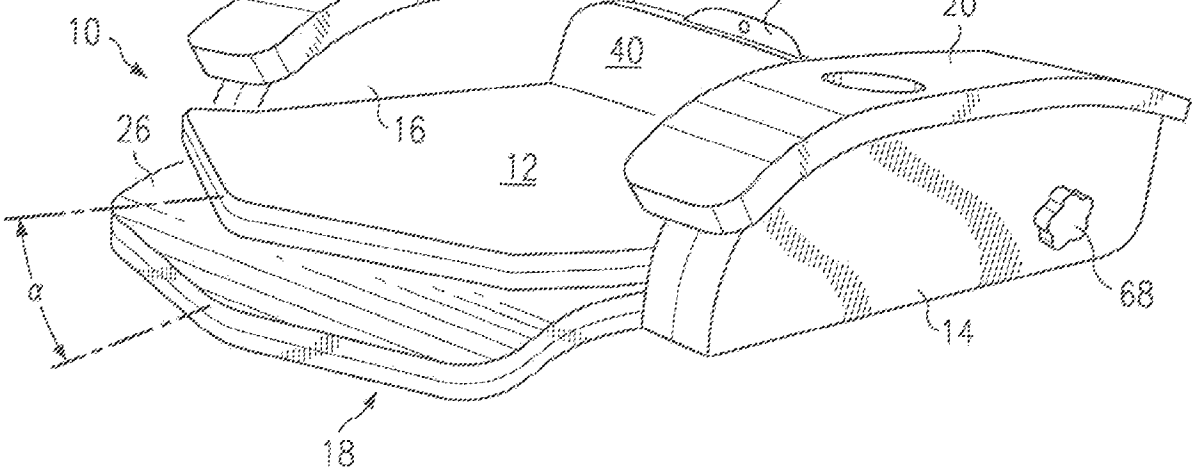
FIG. 11 is a perspective view of the buoyant lounge chair of FIG. 1 with the back folded forward in the minimum profile (storage/shipping) position.
Figure 15:
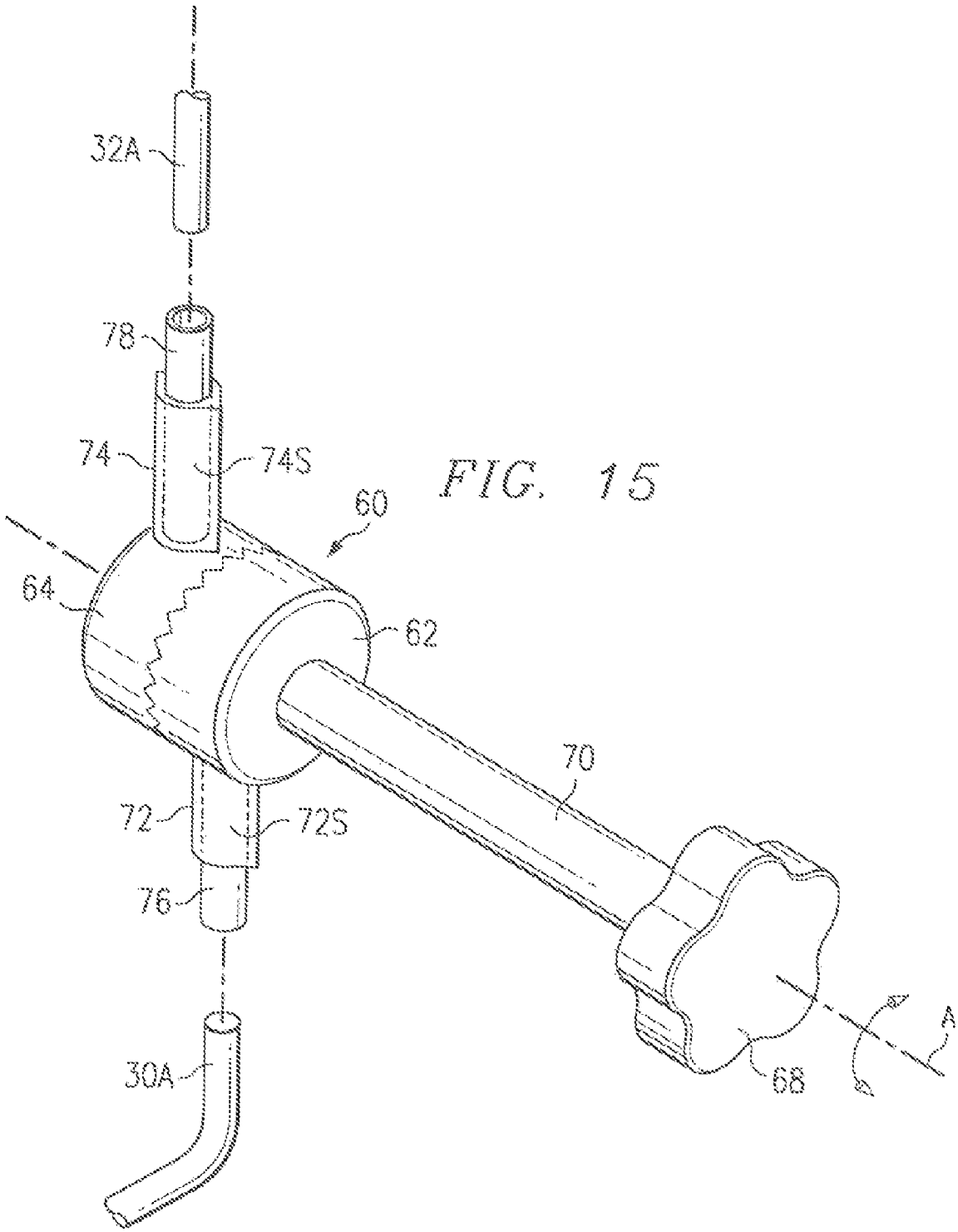
FIG. 15 is a perspective view, partially broken away, of an alternative embodiment of the pivotal coupling and clutch assembly.

Referring again to FIG. 1, FIG. 3 and FIG. 12, the buoyant cushions forming the chair seat 18 and the chair back 12 are preferably formed by first and second layers of buoyant cushion material 18A, 18B that are bonded together in overlapping relation by an adhesive deposit 42. According to this arrangement, the layers of buoyant cushion material forming the chair seat 18 and the chair back 12 are integrally formed together, with the seat frame 30 and the back frame 32 being captured and sandwiched between the overlapping layers. The top buoyant layer 18A forms a continuous body support surface that transitions smoothly through the incline angle $\propto$. The incline angle $\propto$ can be varied through a range of from approximately 10° when the seat back is folded forward in the minimum profile position as shown in FIG. 11, to approximately 90° when the seat back 12 is in the upright position as shown in FIG. 1, and through approximately 180° when the seat back 12 is in the fully extended (body float) position as shown in FIG. 10.

Referring again to FIG. 6, FIG. 7 and FIG. 11, a flexible tie-off grommet 50 is attached to the bolster frame 38. The tie-off grommet 50 is enclosed and sealed between the lower and upper buoyant bolster layers 40A, 40B. An externally projecting portion of the tie-off grommet includes an eyelet for attachment to a tether line whereby the lounge chair 10 can be secured to a fixed structure such as a pool ladder so that the lounge chair will not be blown away during high winds. Also, the tie-off grommet can be used to hang the lounge chair from an overhead hook for inside sheltered storage, preferably with the lounge chair folded into its minimum profile configuration as shown in FIG. 11.

Figure 8:
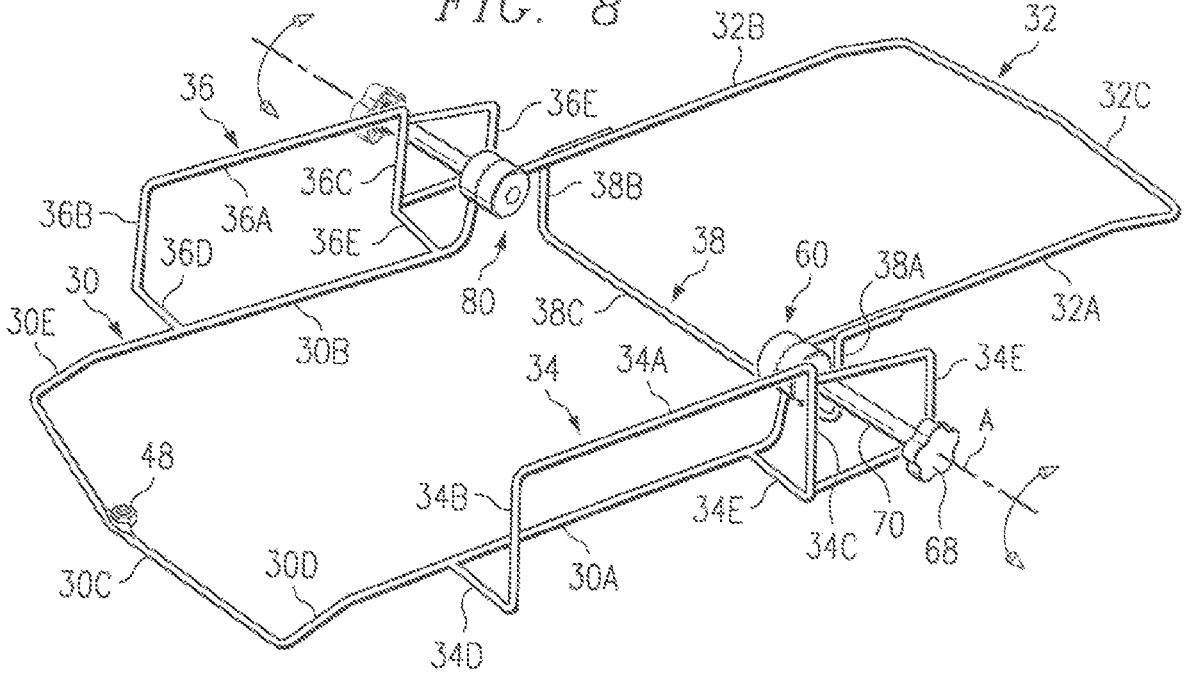
FIG. 8 is a perspective view of the open chair frame of FIG. 2 with the pivotal back frame in the extended, fully reclining (body float) position.
Figure 9:
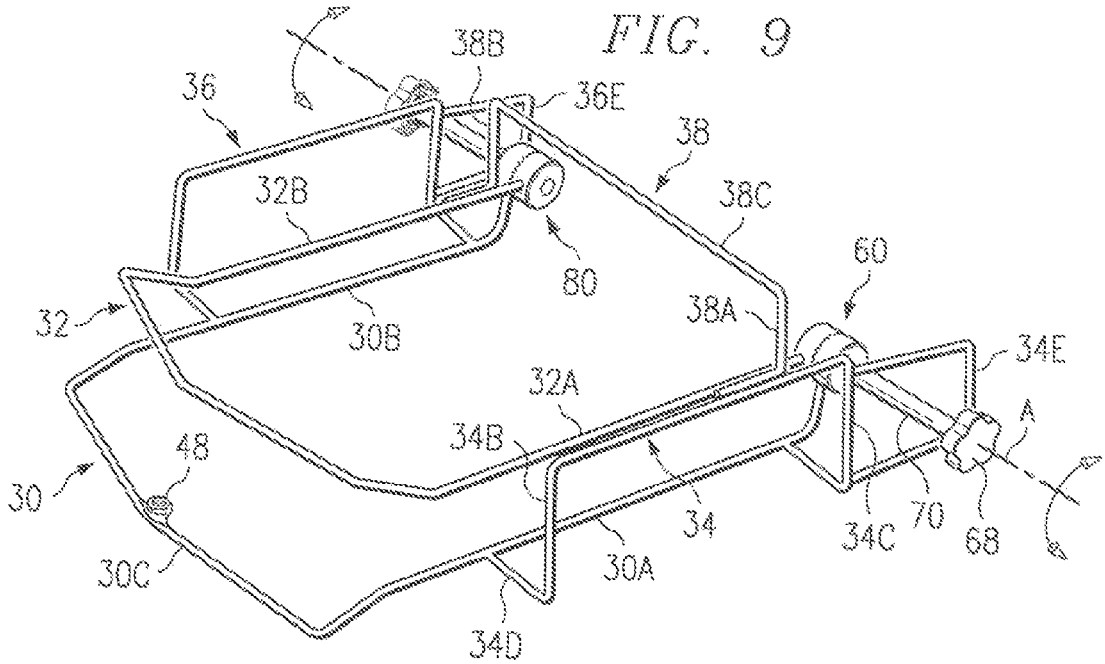
FIG. 9 is a perspective view of the open chair frame of FIG. 2, showing the back frame in the folded, minimum profile (storage/shipping) position.
Figure 16:
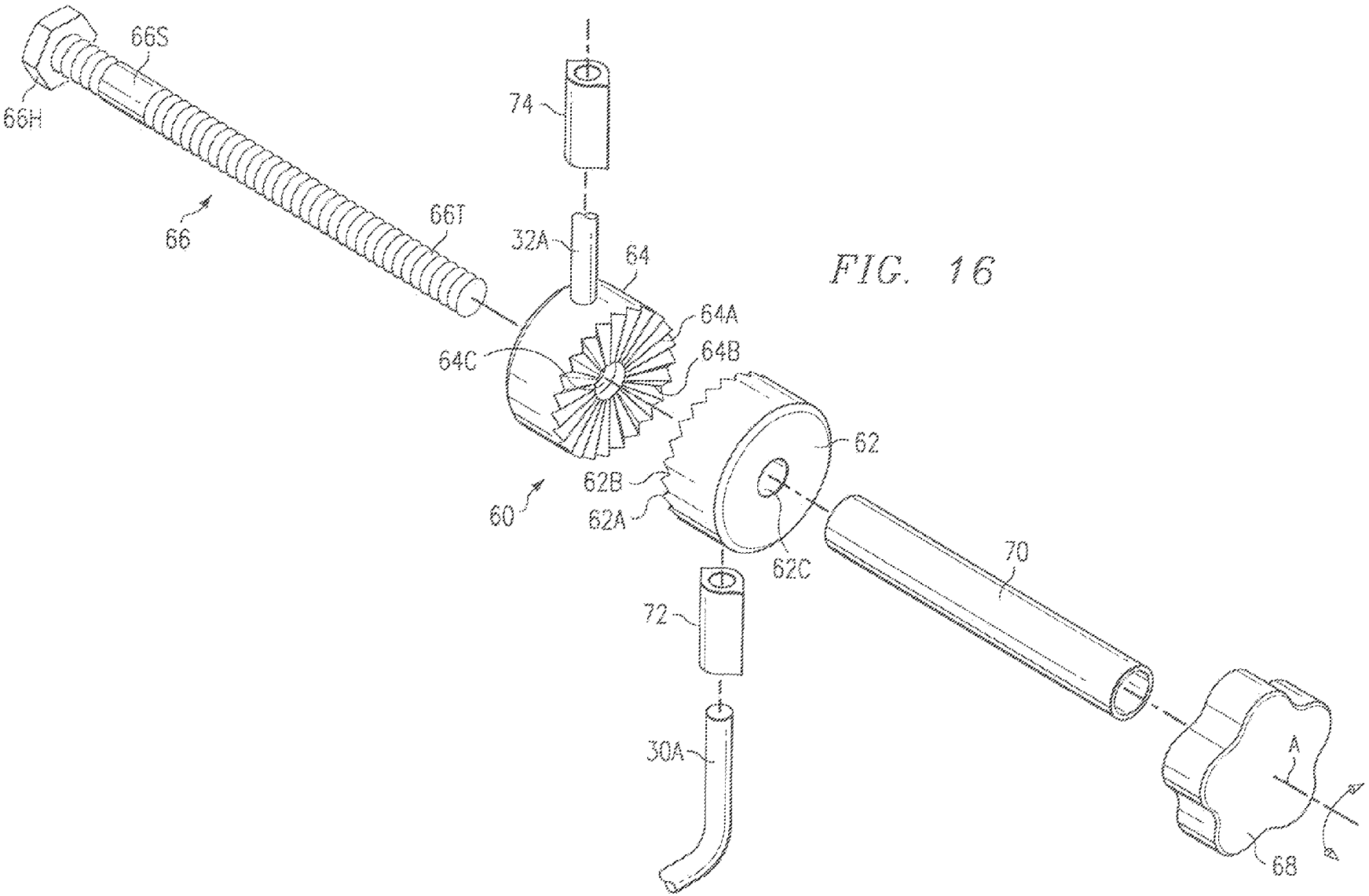
FIG. 16 is an exploded, perspective view of the pivotal coupling and clutch assembly of the present invention.

According to an important feature of the present invention, the back frame 32 is pivotally coupled to the seat frame 30 by a pair of clutch assemblies 60, 80 as shown in FIG. 2, FIG. 8 and FIG. 16. The construction of the clutch assembly 80 is identical to the clutch assembly 80. Referring in particular to FIG. 14 and FIG. 16, the clutch assembly 60 includes a fixed clutch member 62 attached to the seat frame 30A and a rotatable clutch member 64 attached to the back frame 32A. The fixed clutch member 62 and the rotatable clutch member 64 include complementary male and female end portions 62A, 62B and 64A, 64B that are adapted for mating engagement with each other when the clutch members are in the engaged position as shown in FIG. 14. Preferably, the male and female end portions consist of V-shaped ribs 62A, 64A and V-shaped pockets 62B, 64B that alternate with each other, wherein the V-shaped ribs on each clutch member are dimensioned and conformed for nesting engagement within the V-shaped pockets on the other clutch member.

Figures 17, 18:
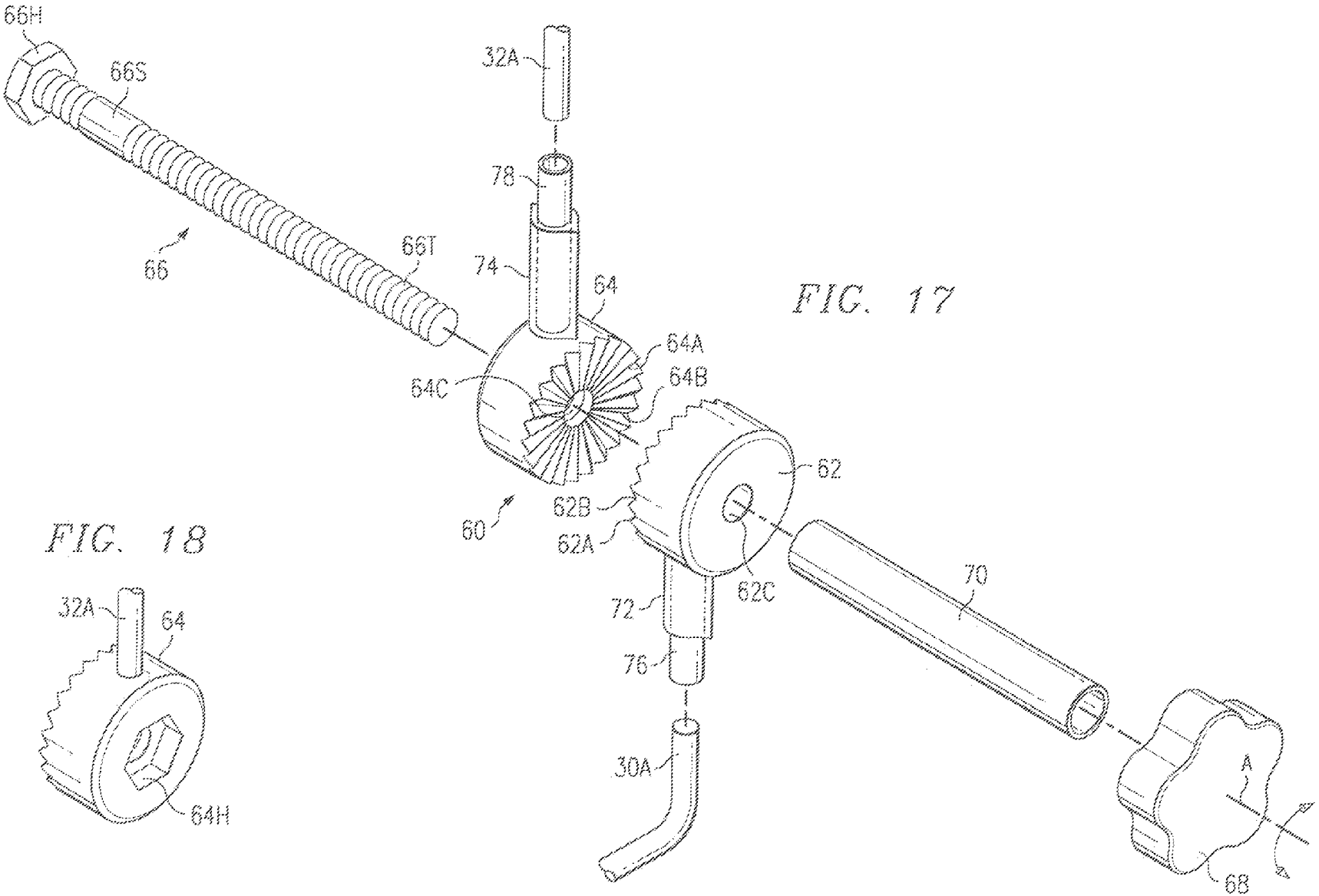
FIG. 17 is an exploded, perspective view similar to FIG. 16, illustrating an alternative embodiment of the pivotal coupling and clutch assembly.
FIG. 18 is a perspective view, partially broken away, of the inside coupling clutch member shown in FIG. 17.

Each clutch member is intersected by a coupling aperture 62C, 64C, respectively, which are in concentric alignment with each other when the clutch members are engaged as shown in FIG. 14. The fixed clutch member 62 and the rotatable clutch member 64 are mounted on a threaded axle shaft 66 which extends through the coupling apertures 62C, 64C. The rotatable clutch member is mounted for rotation on and axial movement along the axle shaft 66 from an engaged position, as shown in FIG. 14, in which the fixed clutch member and the movable clutch member are in contact with each other, to a disengaged position, as shown in FIG. 17, in which the fixed clutch member 62 and the rotatable clutch member 64 are separated from each other.

The angular position of the rotatable clutch member 64 relative to the fixed clutch member 62 is maintained by a manually operable actuator 68 and a compression tube 70. Referring to FIG. 14, FIG. 17 and FIG. 18, the axle shaft 66 extends through the coupling apertures 62C, 64C of the fixed clutch member and rotatable clutch member, and also through the compression tube 70. The threaded end 66T of the axle shaft is engaged by a complementary threaded retainer 68R coaxially embedded, preferably by molding, within the actuator knob 68. As the actuator knob 68 is turned clockwise or counterclockwise, the actuator knob travels axially along the threaded end portion 66T against or away from the compression tube 70. The fixed clutch member 62 and the rotatable clutch member 64 are forced together in compressive engagement as the actuator knob 68 is rotated clockwise against the compression tube, and the clutch members 62, 64 are permitted to pull apart as the actuator knob 68 is rotated counterclockwise and travels away from the compression tube. Rotation of the axle shaft 66 is prevented by engagement of a hex head portion 66H within a complementary hex pocket 64H formed in the rotatable clutch member 64, as shown in FIG. 18. Preferably, the axle shaft 66 includes a smooth, cylindrical bearing surface 66S which is in registration with the coupling aperture 64C. This permits the rotatable clutch member 64 to ride on a smooth bearing surface during rotation of the back frame.

The length of the compression tube 70 and the length of the threaded portion 66T of the axle shaft 66 are selected appropriately so that the compression tube 70 extends through the side arm cushions 14A, 14B, with the threaded end portion 66T and the actuator knob 68 projecting externally of the side arm frame cushion 14B, as shown in FIG. 1 and FIG. 5. The actuator knob 68 is conveniently located so that the operator can manually release and set each clutch to permit pivotal movement of the back frame 32 relative to the seat frame 30, and to adjust and fix the angle of recline according to personal preference.

Referring to FIG. 1, FIG. 5 and FIG. 12, it will be appreciated that each clutch assembly 60, 80 is covered by the overlapping buoyant cushions that form the chair seat and the chair back. Preferably, the clutch members are constructed of a high strength, moldable plastic material such as polyvinyl chloride (PVC) or nylon which does not corrode when exposed to water. The frame rod segments, which are made of steel, should be sealed and protected from exposure to water to prevent rust. For this purpose, the seat frame segments 30A, 30B and the back frame segments 32A, 32B are adhesively sealed between the overlapping buoyant cushions 12A, 12B as shown in FIG. 13.

The water-tight seal is intensified and reinforced around the steel rod frame segments at the union with the clutch members by a first surface augmentation collar 72 and a second surface augmentation collar 74. The augmentation collars 72, 74 are formed as integrally molded parts of the clutch members 62, 64, and present enlarged side surfaces 72S, 74S, respectively, for adhesively bonding and forming a water-tight seal with the overlapping buoyant seat cushions 18A, 18B and overlapping buoyant back cushions 12A, 12B, as shown in FIG. 12 and FIG. 13.

Figure 19:
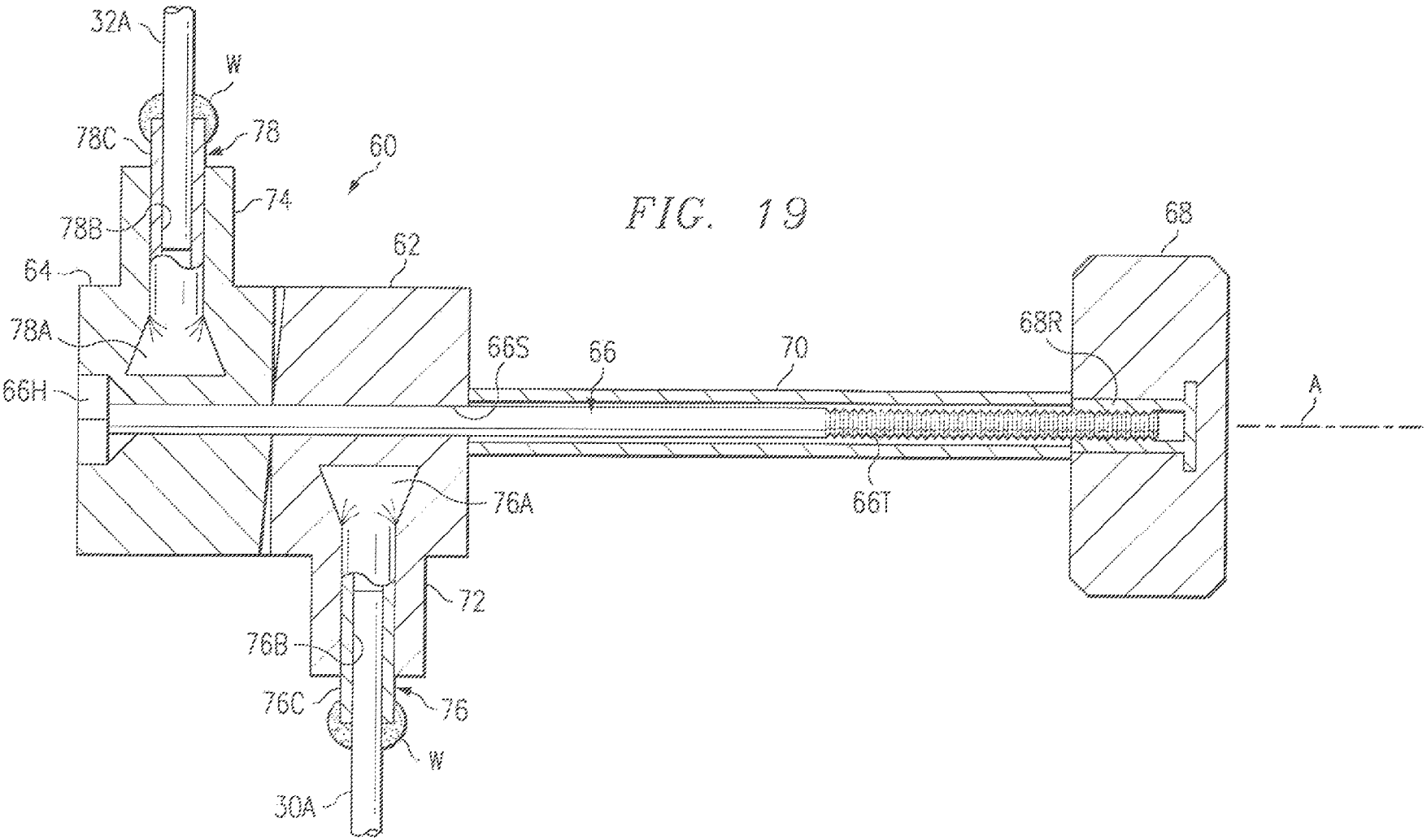
FIG. 19 is a sectional view of the pivotal coupling and clutch assembly shown in FIG. 17, with the clutch assembly in the engaged operative position.

Referring now to FIG. 13, FIG. 15, FIG. 16, FIG. 17 and FIG. 19, the union between each clutch member and the frame segment is reinforced by a tubular steel coupling sleeve 76 which is molded into and embedded within the fixed clutch member 62, and a tubular steel coupling sleeve 78 which is molded into and embedded within the body of the rotatable clutch member 64. According to this arrangement, the tubular coupling sleeves 76, 78 are preassembled and molded within the clutch members, and the surface augmentation collars 72, 74 are integrally molded around the tubular body portions 76C, 78C which project externally of the clutch members, as shown in FIG. 19.

During assembly, the steel rod seat frame segment 30A is inserted into the bore 76B of the tubular steel coupling sleeve 76, and is then welded to the tubular steel coupling sleeve. Likewise, the steel rod seat frame segment 32A is inserted into the bore 78B tubular steel coupling sleeve 78 and then is also welded to the tubular coupling sleeve. This arrangement facilitates assembly of the buoyant lounge chair, and provides a more reliable water-tight seal around the chair frame segments that are subject to corrosion. The weldment bead W between the chair frame segments and the tubular coupling sleeves, together with the embedded end portions 76A, 78A assure a permanent bond between the chair frame and each clutch member, and prevents separation of the back frame from the seat frame.

Figure 20:
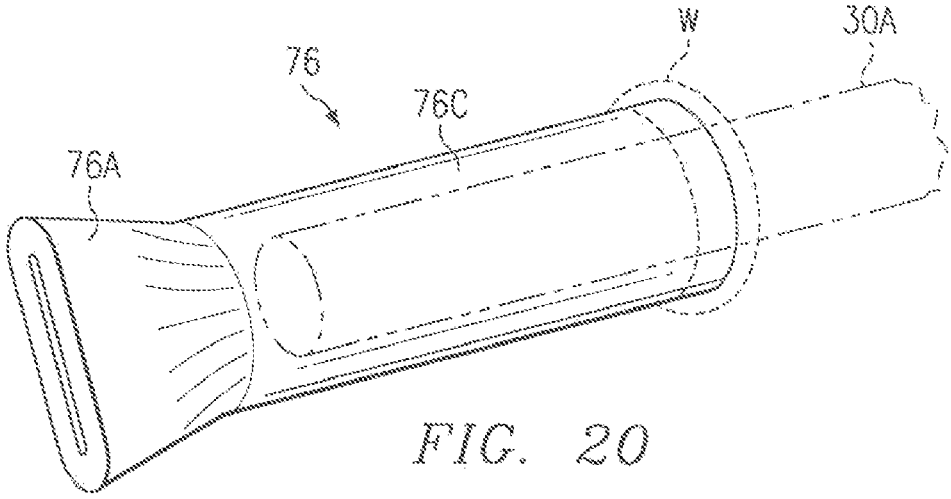
FIG. 20 is a perspective view of the tubular steel coupling sleeve shown in FIG. 19.
Figure 21:
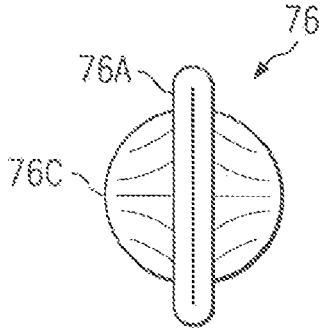
FIG. 21 is a left side elevational view thereof.
Figure 22:
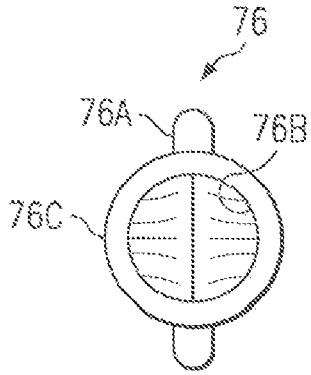
FIG. 22 is a right side elevational view thereof.

Referring now to FIG. 19, FIG. 20, FIG. 21 and FIG. 22, one end portion 76A of the tubular steel coupling sleeve 76 is flattened or crimped with a swage tool, as shown in FIG. 20, which causes the end portion to be radially enlarged and flare radially outwardly from the tubular sleeve body portion 76C. The radially enlarged end portion 76A is totally embedded and molded within the clutch body 62, thereby preventing twisting movement or axial movement of any kind of the tubular steel coupling sleeve with respect to the clutch body 62, thus firmly locking it into place. After the steel rod seat frame segment 30A is inserted into the cylindrical bore 76B of the steel coupling sleeve 76, as shown in FIG. 19, the two pieces are welded together by a weld bead W. The back frame segment 32A is secured in a welded union W with a tubular steel coupling sleeve 78 which is identically formed with a radially enlarged, flared end portion 78A. The result is a high strength union which can withstand rough handling without separation and is protected against corrosion.

Figure 23:
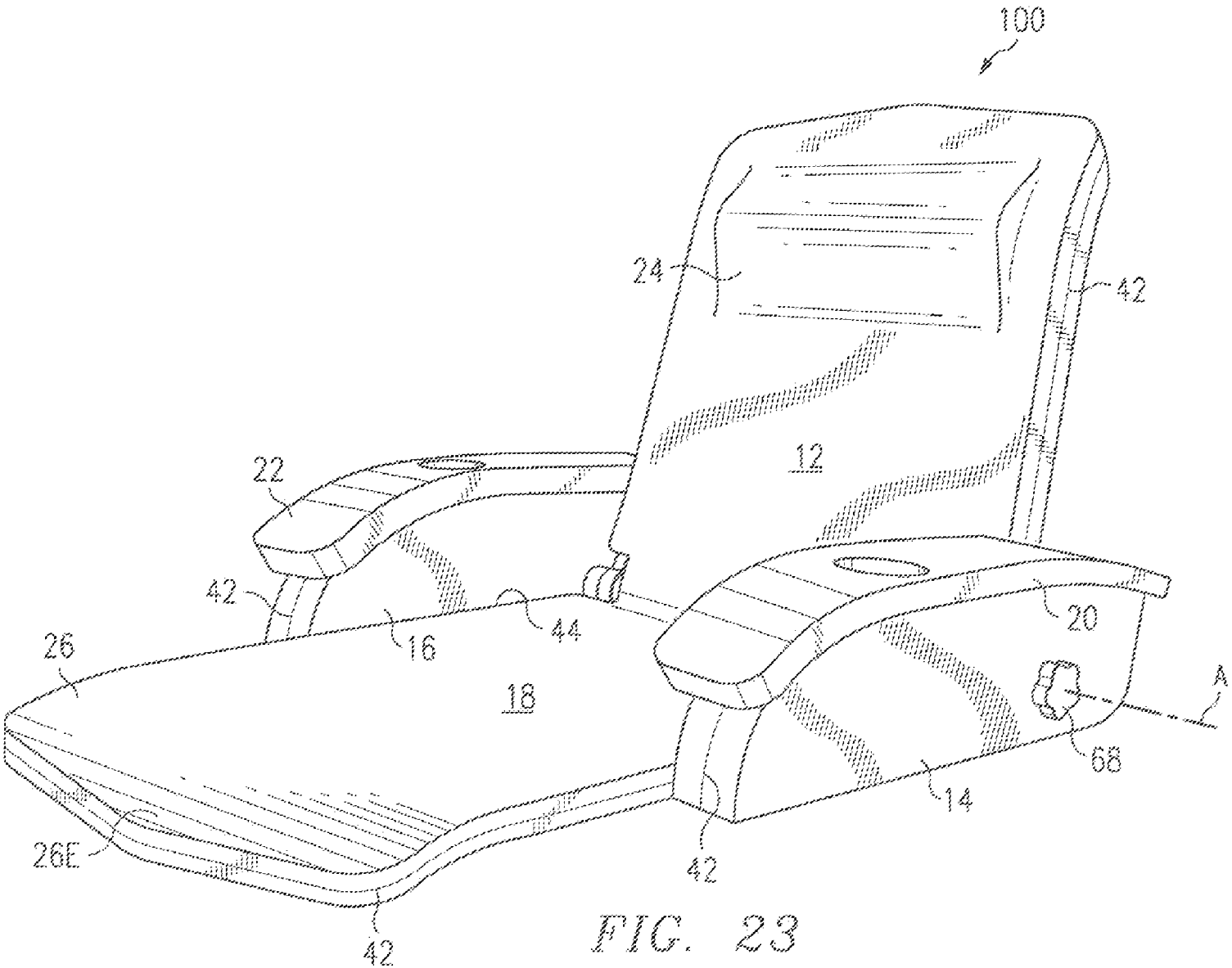
FIG. 23 is a perspective view of an alternative embodiment of the buoyant lounge chair of FIG. 1 which includes an extended leg support section.

Referring now to FIG. 23, an alternative lounge chair embodiment 100 includes an extended buoyant cushion portion 26E that projects forward of and in cantilevered relation to the central seat frame segment 30C. The extended length of the leg support section provides complete support for the swimmer's entire body, including his legs and feet, when the seat back 12 is set in the fully extended, body float position as shown in FIG. 10. The lounge chair 100 shown in FIG. 12 is identical in construction with the lounge chair 10 shown in FIG. 1, except for the additional leg support length.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

What is claimed is:

1. A lounge chair for supporting a person while the chair is floating in water, comprising:

interconnected rigid frame members collectively forming a chair frame, the rigid frame members including a seat frame, a back frame coupled to the seat frame, and a left arm frame and a right arm frame attached to the seat frame, the left arm frame and the right arm frame being continuously, rigidly and immovably elevated above the seat frame and continuously, rigidly laterally offset from the seat frame;

buoyant cushions attached to the frame members, the buoyant cushions forming a chair seat, a chair back, a left chair arm and a right chair arm; and aft extending cushion portions integrally formed from the buoyant cushions of the left arm chair and the right arm chair.

2. The lounge chair as set forth in claim 1, further comprising:

pivot apparatus attached to the seat frame and to the back frame for permitting closing rotational movement of the back frame toward the seat frame to a folded position in which the back frame extends proximate the seat frame, and permitting opening rotational movement of the back frame away from the seat frame to an upright position in which the back frame projects transversely to the seat frame.

3. The lounge chair as set forth in claim 1, wherein the seat frame, the back frame the left arm frame and the right arm frame are enclosed and sealed within the buoyant cushions.

4. The lounge chair as set forth in claim 1, one of the buoyant cushions forming a continuous body support surface that transitions through an angle from the chair back to the chair seat when the chair seat is in the upright position.

5. The lounge chair as set forth in claim 1, further comprising a flexible layer of a water-resistant, protective coating material applied to external surface portions of the buoyant cushions.

6. A lounge chair for supporting a person while the chair is floating in water, comprising:

interconnected rigid frame members collectively forming a chair frame, the rigid frame members including a seat frame, a back frame coupled to the seat frame, and a left arm frame and a right arm frame attached to the seat frame, the left arm frame and the right arm frame being continuously, rigidly and immovably elevated above the seat frame and continuously, rigidly laterally offset from the seat frame;

buoyant cushions attached to the frame members, the buoyant cushions forming a chair seat, a chair back, a left chair arm contoured for an arm of a person and a right chair arm contoured for an arm of a person; and aft extending cushion portions integrally formed from the buoyant cushions of the left arm chair and the right arm chair.

7. The lounge chair as set forth in claim 6, wherein each of the contoured left and right chair arms comprise a buoyant material shaped to support an arm of a person.

8. The lounge chair as set forth in claim 6, further comprising:

pivot apparatus attached to the seat frame and to the back frame for permitting closing rotational movement of the back frame toward the seat frame to a folded position in which the back frame extends proximate the seat frame, and permitting opening rotational movement of the back frame away from the seat frame to an upright position in which the back frame projects transversely to the seat frame.

9. The lounge chair as set forth in claim 6, wherein the seat frame, the back frame the left arm frame and the right arm frame are enclosed and sealed within the buoyant cushions.

10. The lounge chair as set forth in claim 6, one of the buoyant cushions forming a continuous body support surface that transitions through an angle from the chair back to the chair seat when the chair seat is in the upright position.

11. The lounge chair as set forth in claim 6, further comprising a flexible layer of a water-resistant, protective coating material applied to external surface portions of the buoyant cushions.

12. A lounge chair for supporting a person while the chair is floating in water, comprising:

interconnected rigid frame members collectively forming a chair frame, the rigid frame members including a seat frame, a back frame coupled to the seat frame, and a left arm frame and a right arm frame attached to the seat frame, the left arm frame and the right arm frame being continuously, rigidly and immovably elevated above the seat frame and continuously, rigidly laterally offset from the seat frame;

buoyant cushions attached to the frame members, the buoyant cushions forming a chair seat, a chair back, a left chair arm and a right chair arm;

aft extending cushion portions integrally formed from the buoyant cushions of the left arm chair and the right arm chair; and a pivot apparatus attached to the seat frame and to the back frame for permitting closing rotational movement of the back frame toward the seat frame to a folded position in which the back frame extends proximate the seat frame, and permitting opening rotational movement of the back frame away from the seat frame to an upright position in which the back frame projects transversely to the seat frame.

13. The lounge chair as set forth in claim 12, wherein the seat frame, the back frame the left arm frame and the right arm frame are enclosed and sealed within the buoyant cushions.

14. The lounge chair as set forth in claim 12, one of the buoyant cushions forming a continuous body support surface that transitions through an angle from the chair back to the chair seat when the chair seat is in the upright position.

15. The lounge chair as set forth in claim 12, further comprising a flexible layer of a water-resistant, protective coating material applied to external surface portions of the buoyant cushions.

* * * * *